US009771912B2

(12) United States Patent
Vorbach

(10) Patent No.: US 9,771,912 B2
(45) Date of Patent: Sep. 26, 2017

(54) FUEL INJECTOR FOR INTERNAL COMBUSTION ENGINES

(75) Inventor: Marco Vorbach, Freiberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 329 days.

(21) Appl. No.: 14/124,764

(22) PCT Filed: Apr. 25, 2012

(86) PCT No.: PCT/EP2012/057519

§ 371 (c)(1),
(2), (4) Date: Mar. 11, 2014

(87) PCT Pub. No.: WO2012/167992

PCT Pub. Date: Dec. 13, 2012

(65) Prior Publication Data

US 2014/0190451 A1 Jul. 10, 2014

(30) Foreign Application Priority Data

Jun. 9, 2011 (DE) ..... 10 2011 077 272

(51) Int. Cl.
*F02M 59/46* (2006.01)
*F02M 69/04* (2006.01)
(Continued)

(52) U.S. Cl.
CPC ..... *F02M 69/04* (2013.01); *F02M 61/06* (2013.01); *F02M 61/1806* (2013.01);
(Continued)

(58) Field of Classification Search
CPC ..... F02M 61/1853; F02M 61/1806; F02M 61/162; F02M 69/04; F02M 61/06; F02M 61/188; F02M 61/1893; F02M 61/1886; F02M 2200/06
USPC ..... 123/445, 296, 467; 239/533.12
See application file for complete search history.

(56) References Cited

U.S. PATENT DOCUMENTS

2010/0193612 A1* 8/2010 Schrade ..... F02M 51/0671 239/533.12
2012/0180757 A1* 7/2012 Gerber ..... F02M 61/1866 123/294

FOREIGN PATENT DOCUMENTS

DE 19605368 8/1997
DE 10163909 7/2003
(Continued)

OTHER PUBLICATIONS

International Search Report for PCT/EP2012/057519, issued on Jul. 26, 2012.

*Primary Examiner* — Syed O Hasan
(74) *Attorney, Agent, or Firm* — Norton Rose Fulbright US LLP; Gerard Messina

(57) ABSTRACT

A fuel injector for internal combustion engines is provided, which has a valve seat member, bordering a valve chamber, having a valve seat and spray orifices and a central blind-end bore as well as a valve member that is able to be driven to cause a lift motion having a closing head, which, together with a valve seat, forms a sealing seat lying upstream of the spray orifices. In order to prevent an underpressure developing in the blind-end bore in the closing phase of the sealing seat, and a partial return flow of the fuel connected with it, the closing head of the valve member is provided, at its end face facing towards the valve seat member, with a plunger sticking out from closing head, which has a shape adjusted to the contour of the blind-end bore, and dips into the blind-end bore when the sealing seat is closed.

11 Claims, 2 Drawing Sheets

(51) Int. Cl.

| | |
|---|---|
| ***F02M 61/00*** | (2006.01) |
| ***F02M 57/04*** | (2006.01) |
| ***F02M 61/06*** | (2006.01) |
| ***F02M 61/18*** | (2006.01) |

(52) U.S. Cl.
CPC ..... *F02M 61/188* (2013.01); *F02M 61/1886* (2013.01); *F02M 61/1893* (2013.01); *F02M 2200/06* (2013.01)

(56) References Cited

FOREIGN PATENT DOCUMENTS

| | | | | |
|---|---|---|---|---|
| DE | 102005036951 | | | 2/2007 |
| DE | WO2011033036 | | * | 3/2011 |
| EP | 1995448 | | | 11/2008 |
| FR | 1190361 | | | 10/1959 |
| JP | 03294655 | | | 12/1991 |
| JP | H03-294655 | A | | 12/1991 |
| JP | 04112965 | | | 4/1992 |
| JP | 08247002 | | | 9/1996 |
| JP | H08-247002 | A | | 9/1996 |
| JP | H09-14091 | A | | 1/1997 |
| JP | 2002-332935 | A | | 11/2002 |
| JP | 2005-337192 | A | | 12/2005 |
| JP | 2008-507663 | A | | 3/2008 |
| JP | EP1995448 | | * | 11/2008 |
| JP | 2010-038126 | A | | 2/2010 |
| JP | 201038126 | | | 2/2010 |
| WO | WO 2011/033036 | | | 3/2011 |

* cited by examiner

FUEL INJECTOR FOR INTERNAL COMBUSTION ENGINES

FIELD OF THE INVENTION

The present invention is based on a fuel injector for internal combustion engines.

BACKGROUND INFORMATION

One known fuel injector, designed as a so-called multi-orifice fuel injector for internal combustion engines, see German Published Patent Appln. No. 10 2005 036 951, has a valve seat member accommodated at its end in a hollow cylindrical valve seat support, which, using an inner body wall, bounds a valve chamber that is in connection to a fuel supply. A valve seat is developed on the inner body wall of the valve seat support. A plurality of spray orifices are situated in the valve seat body, which, in the inner body wall, namely in the range of the body wall enclosed by the valve seat, has orifice entry openings situated, and in the outer convex body wall of the valve seat body, facing away from the valve chamber, has orifice exit openings. Each of the plurality of spray orifices has an orifice entry section having a small cross section, bordered upstream by the orifice entry opening and an orifice exit section having a larger cross section that is bordered downstream by the orifice exit opening. Together with a closing member, the valve seat forms a sealing seat lying upstream of the spray orifices that is axially displaceable in the valve seat support and is drivable for the lift motion. Within the range of the body wall of the valve seat body enclosed by the orifice entry openings of the spray orifices, a blind-end bore having a blind-end bore opening towards the valve chamber has been worked into the body wall. Such a blind-end bore is used as a stabilizing volume for damping a highly turbulent fuel flow which, at full lift of the valve member in this area, develops by an excess of fuel for the spray orifices.

It has turned out that, in the closing phase of the valve at the end of the injection, as a result of the inertia injection orifice flow, an underpressure is created in the blind-end bore and thereby a partial return flow of the fuel to the blind-end bore takes place, Because of this return flow, a clear reduction in the preparation quality of the fuel is created, which increases the soot emission in the exhaust gas and promotes coking, i.e. deposits from combusted fuel, at the orifice exit openings of spray orifices.

SUMMARY

The fuel injector according to the present invention, has the advantage that, because of the plunger developed on the closing head and dipping into the blind-end bore in the closing phase of the valve member displaces the fuel volume stored in the blind-end bore and it is sprayed off as an additional injection quantity. A return flow of the fuel is prevented and coking at the spray orifice exits is counter-acted. The required pressure for a good atomization of the injection quantity displaced from the blind-end bore is built up by the dynamics of the valve member. The blind-end bore still remains present as stabilizing space at full lift of the valve member for the highly turbulent cross flow, and the disadvantages of a valve seat body not having a blind-end bore are avoided.

According to one advantageous specific embodiment of the present invention, blind-end bore and plunger are so adjusted to each other that when the sealing seat is closed, the plunger lies in the blind-end bore in a form-locking manner. Thereby the complete displacement of the fuel volume stored in the blind-end bore is ensured in the closing process.

According to one advantageous specific embodiment of the present invention, the blind-end bore is developed as a hollow and the plunger is developed as a protuberance, and each has a bell shape or a hat shape. The hollow is preferably provide with an elevation sticking out from the base of the hollow and the protuberance is provided with a depression which is adjusted to the contour of the elevation in the hollow. Alternatively, the blind-end bore and the plunger have a frustoconical shape. In both cases, when the valve closes, on the one hand an additional centering of the valve member is achieved and on the other hand a hydraulic damping of the closing pulse of the valve member.

DETAILED DESCRIPTION

Figure 1:
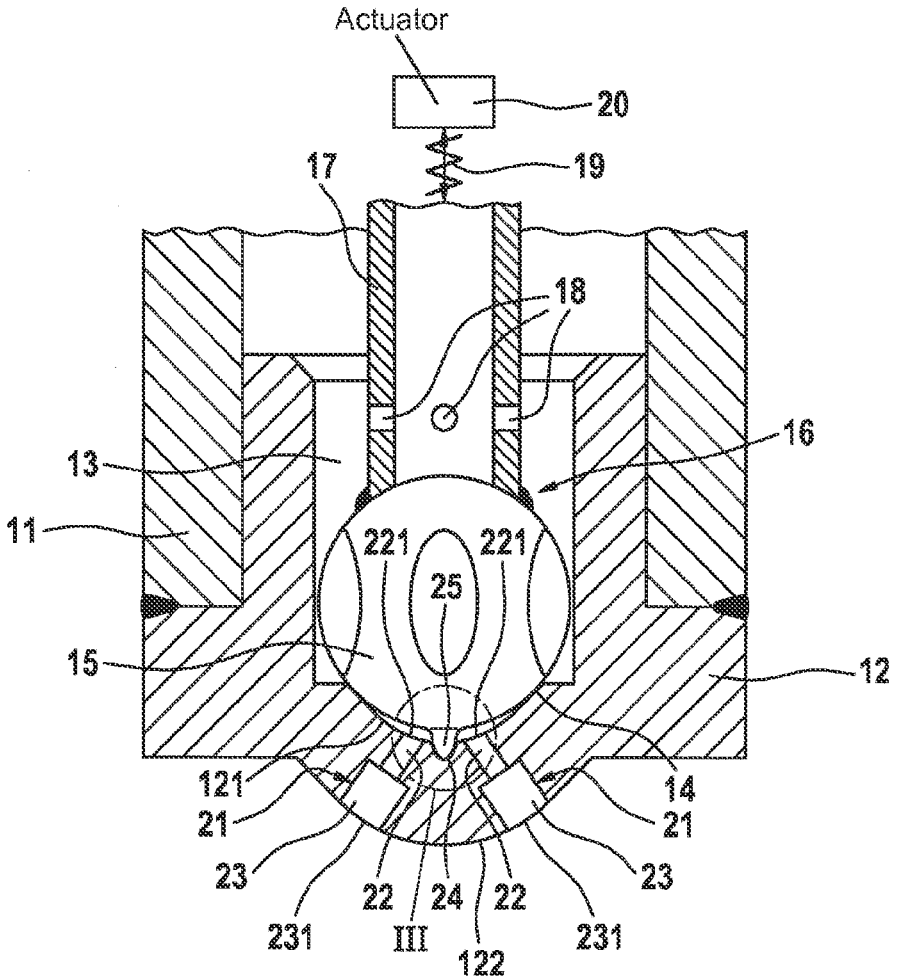
FIG. 1 shows in a cutaway view, a longitudinal section of a fuel injector for an internal combustion engine.

The fuel injector sketched schematically in longitudinal section shown with its spray-off end in a cutaway manner in FIG. 1, for injecting fuel into a combustion cylinder of an internal combustion engine, has a sleeve-shaped valve seat support 11, which projects from a valve housing, that is not shown here, and is closed at its free end by a valve seat member 12. Valve seat member 12 borders a valve chamber 13 with its inner body wall 121. At inner body wall 121 a valve seat 14 is developed in the form of an annular surface that is concentric with the axis of valve seat member 12. Valve seat 14 forms a so-called sealing seat, together with a closing head 15 of a valve member 16 situated axially movable in valve seat support 12. Closing head 15 is fastened at the end face end of a hollow cylindrical valve needle 17 of valve member 16, for instance, by welding. Valve needle 17 has radial bores 18 and is connected to a fuel supply not shown here, but developed in the valve housing, so that fuel gets from the fuel supply via valve needle 17 and radial bores 18 into valve chamber 13 and is present there under pressure at the sealing seat. For the lifting motion of valve member 16, and thus, for the opening and closing of the sealing seat, in a manner known per se, a return spring 19 and an actuator 20, for instance, an electromagnet, which are both shown schematically in FIG. 1, grasp valve member 16. Valve closing spring 19 presses closing head 15 onto valve seat 14. Using actuator 20, closing head 15 is lifted off, more or less far, from valve seat 14 against the returning force of valve closing spring 19.

Downstream of the sealing seat, spray orifices 21 are situated in valve seat member 12, which each have two orifice sections stepped in cross section, namely one upstream orifice entry section 22 having a small orifice cross section and an orifice entry opening 121 and a downstream orifice exit section 23 having a large orifice cross section and an orifice exit opening 231. All orifice entry openings 221, on the one hand, and all orifice exit openings 231, on the other hand, lie on a so-called divider circle in planes parallel to one another, which extend transversely to the axis of valve seat member 12, that is, in the circumferential direction they have the same distances from one another. Orifice entry openings 221 of orifice entry sections 22 are situated, in this instance, in the region enclosed by valve seat 14 of inner body wall 121 of valve seat member 12, while orifice exit openings 231 lie in outer body wall 122, facing away from valve chamber 13, of valve seat body 12, namely, in this case, in a dome-shaped central region of valve seat body 12. Into inner body wall 121 of valve seat body 12 a blind-end bore 24, having a blind-end bore opening pointing to valve chamber 13, is worked in, the axes of blind-end bore 24 and valve seat body 12 being preferably in alignment. This blind-end bore 24 forms a stabilizing space for a highly turbulent transverse flow of the fuel that develops at complete lift of valve member 16 between orifice entry openings 221.

Figure 2:
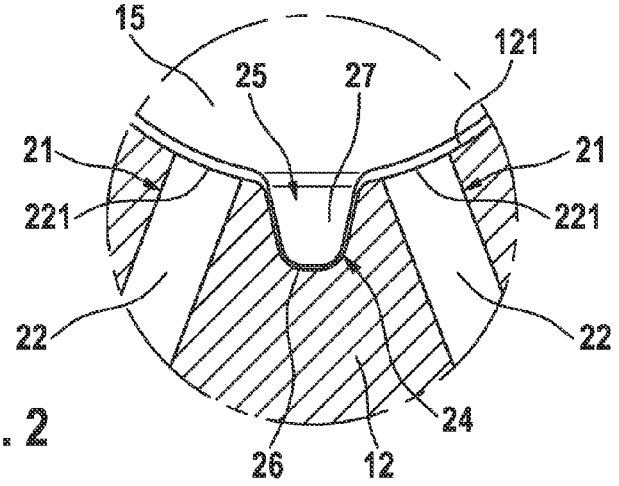
FIG. 2 shows an enlarged view of cutaway view III in FIG. 1.

In order, in the closing phase of the valve, to avoid the development of an underpressure in blind-end bore 24, having the disadvantages described at the outset, closing head 15 of valve member 16 at its end face, facing valve seat member 12, is provided with a plunger 25 that sticks out from closing head 15 which is preferably connected as one piece in an attached form to plunger 25. The shape of plunger 25 is adjusted to the contour of blind-end bore 24, so that in the closing phase of the valve, during closing of the sealing seat, plunger 25 dips into blind-end bore 24 and displaces the fuel volume present there in the direction towards orifice entry openings 221 of the spray orifices. Blind-end bore 24 and plunger 25 are preferably adjusted to each other in such a way that, when the sealing seat is closed, plunger 25 lies in a form-locking manner in blind-end bore 24, and consequently the fuel volume stored in blind-end bore 24 in the closing phase is pushed out completely from blind-end bore 24. In the exemplary embodiment shown in FIG. 1, as is shown more clearly in the enlarged representation of blind-end bore 24 and plunger 25 in FIG. 2, blind-end bore 24 is developed as a hollow and plunger 25 is developed as a protuberance 27, each having a bell-like or a hat-like shape.

Figure 3:
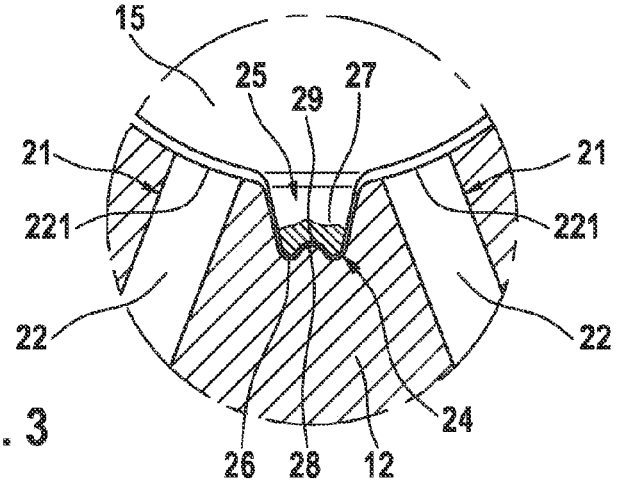
FIG. 3 shows the same representation as in FIG. 2 with a modification of the valve.

In the exemplary embodiment of blind-end bore 24 and plunger 25 according to the modification of the fuel injector shown in FIG. 3, hollow 26 has an elevation 28 sticking out centrically from the base of the hollow, and protuberance 27 has a centrical depression 29, whose shape is adapted to the contour of elevation 28. Using elevation 28 and depression 29, a centering of closing head 15 and the valve seat are achieved upon the closing of the sealing seat. An additional effect, thereby, is a hydraulic damping of the closing pulse of valve seat 16.

Figure 4:
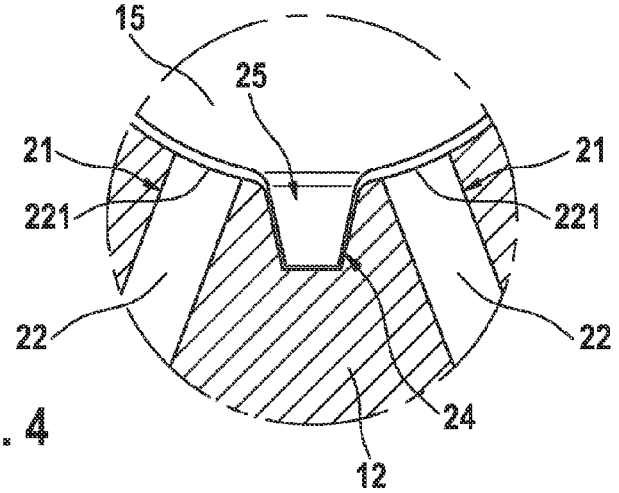
FIG. 4 shows the same representation as in FIG. 2 with an additional modification of the valve.

In the exemplary embodiment shown in FIG. 4 of blind-end bore 24 and plunger 25, blind-end bore 24 and plunger 25 are frustoconical in shape. By this constructive development, the effect of centering valve member 16 and the hydraulic damping of the closing pulse of valve member 16 are reinforced.

What is claimed is:

1. A fuel injector for an internal combustion engine, comprising:

a valve seat member that includes:

a valve chamber;

an inner body wall bordering the valve chamber;

a valve seat developed on the inner body wall;

a blind-end bore having an open end that lies in the inner body wall and extends to a closed end that lies opposite of the open end lying in the inner body wall by which the blind-end bore opens directly into the valve chamber; and a plurality of spray orifices that open directly into the valve chamber via orifice entry openings of the spray orifices that lie in the inner body wall around the open end of the blind-end bore;

a valve member that is able to be driven to perform a lifting motion, the valve member including a closing head which, with the valve seat, forms a sealing seat lying upstream of the orifice entry openings of the spray orifices; and a plunger sticking out from the closing head at an end face of the closing head facing towards the valve seat member, wherein the plunger has a shape adjusted to a contour of the blind-end bore, and is situated in such a way that the plunger dips into the blind-end bore upon a closing of the sealing seat, wherein the blind-end bore and the plunger are bell-shaped, hat-shaped or frustoconical shaped, wherein the plunger is sized to substantially fill, and contact the closed end of, the blind-end bore upon the closing of the sealing seat.

2. The fuel injector as recited in claim 1, wherein the blind-end bore and the plunger are adjusted to each other so that the plunger lies in the blind-end bore in a form-locking manner when the sealing seat is closed.

3. The fuel injector as recited in claim 1, wherein:

the blind-end bore is developed as a hollow, the plunger is developed as a protuberance, and the blind-end bore and the plunger are one of bell-shaped and hat-shaped.

4. The fuel injector as recited in claim 3, wherein:

the hollow has an elevation sticking out centrically from a hollow base, and the protuberance has a centrical depression having a contour that is adjusted to a shape of the elevation.

5. The fuel injector as recited in claim 1, wherein the blind-end bore and the plunger have a frustoconical shape.

6. The fuel injector as recited in claim 1, wherein the plunger is connected in an attached form in one piece to the closing head.

7. The fuel injector as recited in claim 1, wherein:

all the orifice entry openings of the spray orifices are situated on a circle that is concentric with an axis of the valve seat member, at a distance from one another, and an axis of the blind-end bore is in alignment with the axis of the valve seat member.

8. The fuel injector as recited in claim 7, wherein the orifice entry openings have the same distance from one another in a circumferential direction.

9. The fuel injector as recited in claim 1, wherein:

the spray orifices have orifice sections that are stepped in cross section, and the orifice sections have a cross section that increases from the orifice entry openings to orifice exit openings.

10. The fuel injector as recited in claim 1, wherein the plunger is sized to substantially fill the blind-end bore upon the closing of the sealing seat.

11. The fuel injector as recited in claim 1, wherein the plunger is sized to contact the closed end of the blind-end bore upon the closing of the sealing seat.

* * * * *